United States Patent [19]

Koop

[11] Patent Number: 5,006,217

[45] Date of Patent: Apr. 9, 1991

[54] ARRANGEMENT FOR CONTACTING AND HOLDING A MOLD

[75] Inventor: Hermann Koop, Ronnenberg, Fed. Rep. of Germany

[73] Assignee: U.S. Philips Corporation, New York, N.Y.

[21] Appl. No.: 384,223

[22] Filed: Jul. 21, 1989

[30] Foreign Application Priority Data

Jul. 28, 1988 [DE] Fed. Rep. of Germany ..... 3825592

[51] Int. Cl.[5] ..... C25D 17/00

[52] U.S. Cl. ..... 204/297 R; 118/503; 118/620

[58] Field of Search ..... 204/28, 286, 297 R, 204/279; 118/503, 620

[56] References Cited

U.S. PATENT DOCUMENTS 3,414,502 12/1968 Porrata et al. ..... 204/281

4,385,978 5/1983 Prusak ..... 204/281

*Primary Examiner*—John F. Niebling

*Assistant Examiner*—Kathryn Gorgos

*Attorney, Agent, or Firm*—Norman N. Spain

[57] ABSTRACT

In an arrangement for contacting a mold with and holding it on a table, the outer edge of the mold is to be screened from undesired growths by electrodeposition through the use of an elastic collar which embraces the table, while holding and contacting the mold in a reliable manner. This object is achieved in that the table comprises a contact plate which together with the table and the mold forms an annular space for a radial annular flange of the collar, and in that the outer flange is stretched around the table in such a manner that further holding members of the collar urge the mold onto the contact plate through its annular circumferential surface.

15 Claims, 2 Drawing Sheets

ARRANGEMENT FOR CONTACTING AND HOLDING A MOLD

The invention relates to an arrangement for contacting a mold with and holding it on a table, comprising an elastic, non-conducting collar which embraces the table, on the backside by means of an outer flange, and which comprises additional members for holding the mold, and comprising an electric connection between the mold and a cathode on the backside of the arrangement.

Molds of the type mentioned above can be used, for example, for high-density storage discs which are based on a master and which are manufactured by electrodeposition. In general, a negative (father mold) is formed from a master, after which a positive (mother mold) formed from the negative and a stamper son mold) is made of the positive. In order to form a positive from a negative or a stamper from a positive, the starting mold must be properly electrically contacted on the backside and it must be mechanically held in a reliable manner.

In a method of manufacturing as described in the opening paragraph, which is known from U.S. Pat. No. 3,414,502, the electrically insulating table is provided with an electrically conducting surface which is electrically conductively connected to a cathode rod. The cathode rod is rigidly secured to the backside of the table and bent rectangularly directly behind the table. In this known method, the collar in the form of a rubber ring is first stretched around the table after which the mold is placed in the ring. This is a difficult operation when the table is fixedly mounted. Moreover, the rubber ring shields the circumferential part and, in addition, an edge portion of the surface of the mold. Consequently, this method of manufacturing always yields molds whose diameter is smaller than that of the original mold.

SUMMARY OF THE INVENTION

It is an object of the invention to provide an arrangement of the type mentioned in the opening paragraph, by means of which the mold can be fixed in a reliable and simple manner, a proper electrical contact can be established and the outer edge of the mold can be reliably shielded from undefined growths. According to the invention, this object is achieved by means of an arrangement of the type mentioned in the opening paragraph, in that the turntable comprises an electrically conducting contact plate which, together with the table and the mold, forms an annular space for a radial annular flange of the collar, and in that, the outer flange is stretched around the table in such a manner that the mold is pressed onto the contact plate by the further holding members through its annular circumferential surface. Thus, using only one component, i e , the elastic collar, both a suitable electrical contact and a reliable fixation of the mould can be obtained.

The outer edge of the mold is shielded such that molds having edges of a defined thickness which is suitable for further technical use, can be grown by electrodeposition without a change in the diameter of the mold being grown taking place. Further, no uncontrolled metal deposition can take place on the backside of the original mold during the electrodeposition process. The mold is pressed onto the centrically arranged contact disc by the further holding elements of the collar which project above the surface of the mold.

These holding elements engage at the annular circumferential part of the mold, to be more precise, they engage at the annular upper edge of the mold. Consequently, they do not cover any parts of the surface of the mold. Thus, the manufactured mold always have an equal diameter This is important to attain a high reproduction rate. In this connection, the annular flange extending radially inwardly in the annular space between the mold and the table serves as a support for the mold at the location of the outer portion.

In the construction according to the invention, firstly, the mold (original mold) is disposed in the annular collar, after which the collar with the mold is filled on the table. The ratio between the thickness of the table and the wall-length of the collar between the annular flange and the outer flange preferably being selected such that by virtue of the initial stress of the elastic collar the mold is pressed onto the contact disc.

DETAILED DESCRIPTION OF THE INVENTION

Figure 1:
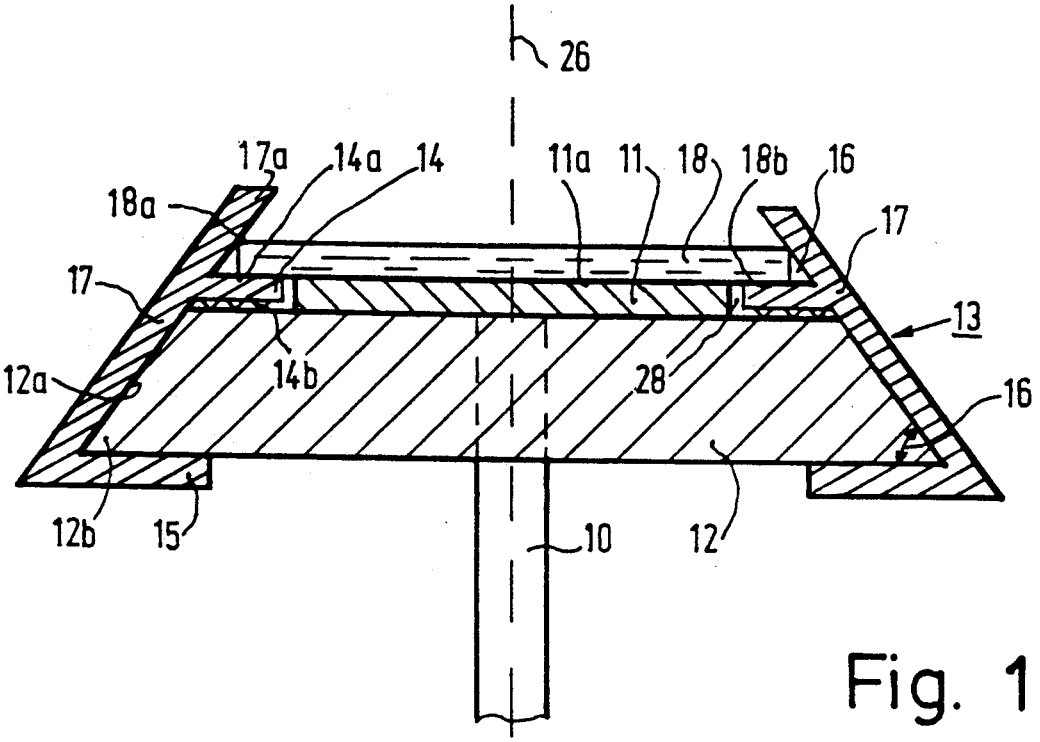
FIG. 1 is a cross-sectional view of an arrangement of the invention comprising an annular collar whose diameter is smaller at the location of the annular plane than at the location of the outer flange, A cross-sectional view of FIG. 2 is an arrangement of the invention comprising an annular collar whose diameter is equal at the location of the annular plane and at the location of the outer plane.

According to a preferred embodiment, the diameter of the collar is smaller at the location of the radial annular flange than at the location of the outer flange embracing the table, the further holding members of the collar, which serve to press the mold onto the contact disc, being formed as extensions of the collar wall. In this manner, a very simple construction is obtained. In a further embodiment, the outer flange is constructed as a radial annular flange with an acute angle, and the table has a trapezoidal cross-section. By forming the collar in the above-described manner, a construction is obtained in which the annular flange and the outer flange each form an acute angle with the annular outer wall of the collar. The outer edge of the mold is located in the acute angle which is formed by the annular flange, and, hence, the mold is pressed against the contact plate. On account of the trapezoidal shape of the turntable, a slope is obtained, so that the collar with its outer flange can be fitted more easily, and a centering of the mold on the contact plate is obtained.

In a further embodiment according to the invention, the diameter of the collar may alternatively be equal at the location of the annular flange and the outer flange, the table having a rectangular cross-section and the further holding members of the collar, which serve to urge the mold onto the contact plate, being in the form of a thickened portion. Also, in this arrangement, the above advantages are essentially obtained.

Preferably, the surface of the annular flange which is located opposite the outer ring surface of the mold extends in one plane with the surface of the contact disc. Thus, a suitable contact and a reliable support of the mold in its outer portion are obtained. In a further embodiment of the invention, and depending upon the circumstances, the contact surface of the contact disc may project beyond the surface of the annular flange, to such an extent that no deformation of the mold takes place. This must be arranged such that the mold is suitably supported at the location of its outer portion and that a reliable contact is ensured. When the contact disc is located too high, the mold may become deformed.

In a further embodiment according to the invention, the bottom surface of the annular flange facing the table is provided with laminations. In this manner, an additional seal is formed between the bottom surface of the annular flange and the upper surface of the synthetic resin table. Preferably, the diameter of the contact disc is smaller than or equal to the diameter of the inner space surrounded by the annular flange With a view to possible growths on the backside of the mold, he sealing is better according as the interval between the edges of the annular flange and the contact disc is smaller. For example, a rubber collar can be used as the collar.

In an advantageous embodiment of the invention, the table is a turntable, and the cathode is in the form of a cathode rod which is rectangularly arranged relative to the turntable; the turntable, the contact disc with the mold attached thereto and the cathode rod forming a torsion-resistant assembly which can be rotated about the cathode axis. Such a construction ensures a uniform growth in the plating bath.

Exemplary embodiments of the invention are explained in greater detail by means of the accompanying, diagrammatic, cross-sectional drawings.

As is shown in FIG. 1, a cathode rod 10 is rectangularly and electrically conductively connected to a contact disc 11 and torsion-resistantly to a turntable 12 which is composed of an insulating material. Reference numeral 13 denotes a rubber collar comprising an annular flange 14 which extends radially inwardly and an outer flange 15 which, in the present embodiment, is also in the form of a radially inwardly directed annular flange. The annular flange 14 and the outer flange 15 each form an acute angle 16 with the outer wall 17 of the collar 13. Reference numeral 18 denotes a mold which has to be worked and which lies on the contact disc 11 in a torsion-resistant manner. The holding member 17*a* of the collar which projects above the mold 18 urges said mold, whose circumferential part is located in the acute angle 16, against the contact disc 11 in a torsion-resistant manner through the annular upper edge 18*a* of the circumferential face of the mold. The surface 11*a* of the contact disc and the surface 14*a* of the annular flange 14 are located in one plane, so that the mold is supported by the annular flange 14 at the location of its edge portion 18*b*. The outer flange 15 is stretched around the turntable 12 and lies against the outside of the turntable. Due to the trapezoidal shape of the turntable, a sloping face 12*a* and an vertex 12*b* are obtained, centering of the mold on the contact disc 11 being attained by stretching the outer flange around the turntable. Reference numeral 28 denotes an annular space.

Figure 2:
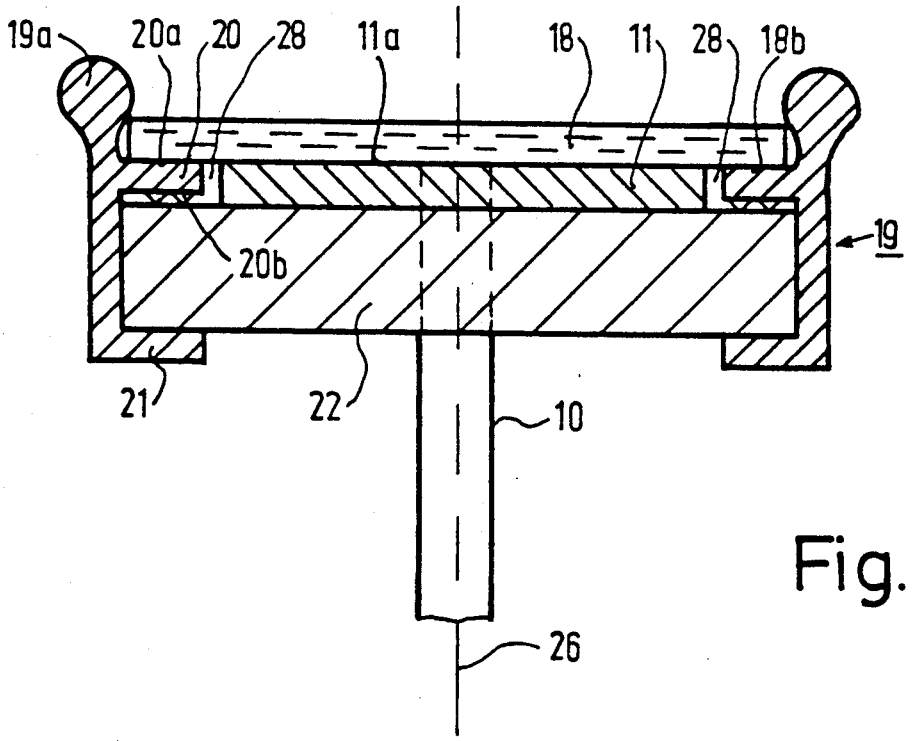

FIG. 2 shows a construction comprising a collar 19 having an annular flange 20 and an outer flange 21 of the same outside diameter. Further, the turntable 22 has a rectangular cross-section. A thickened portion 19*a* which serves as a holding member is shown above the annular flange 20, in the present embodiment, the said thickened portion urges the mold 18 against the contact disc 11 in a torsion-resistant manner.

Figure 3:
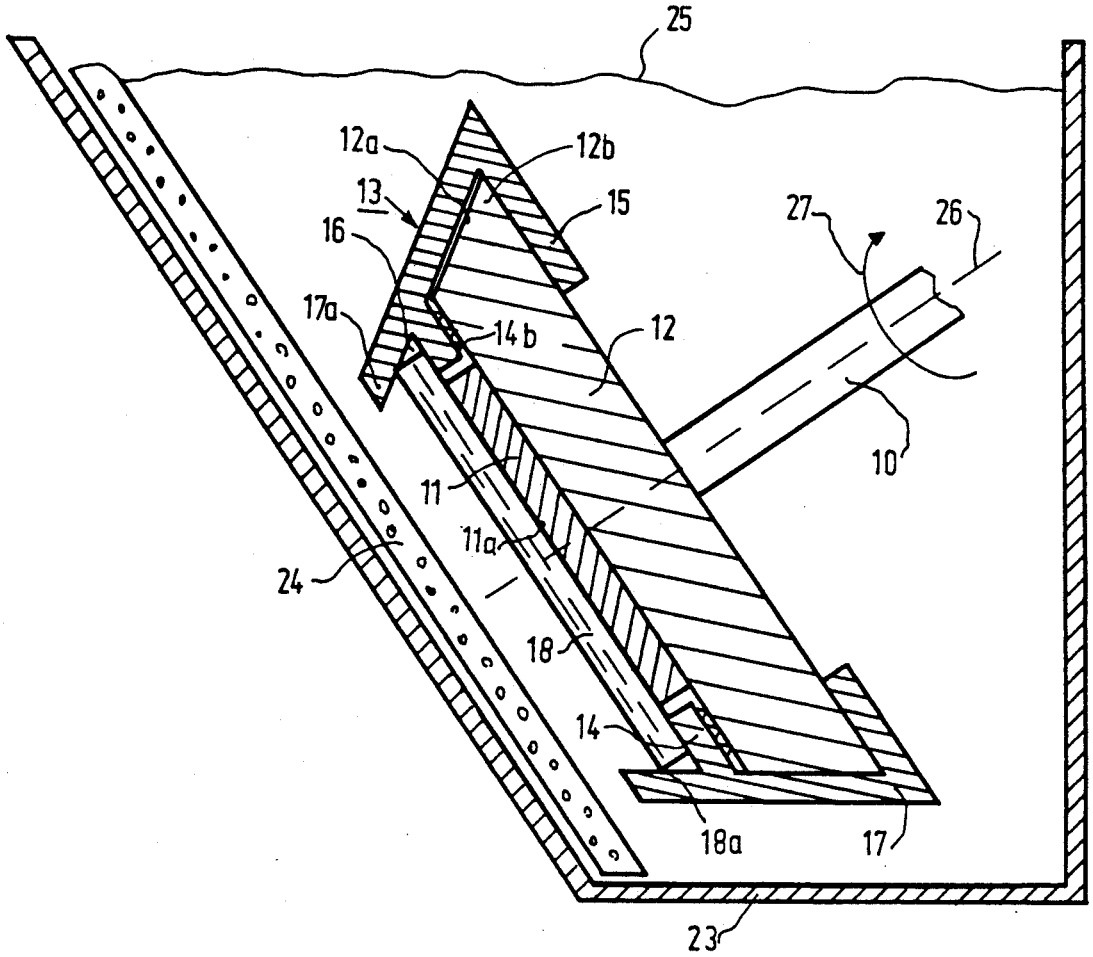
FIG. 3 is a cross-sectional view of a galvanic cell provided with the arrangement of FIG. 1

FIG. 3 shows a galvanic cell 23 comprising an anode 24 which is arranged in an oblique position and an arrangement in accordance with FIG. 1, which is disposed opposite the said anode. Said cell 23 is filled with an electrolyte 25. The cathode rod 10 is mounted so as to be rotatable about its axis 26 in the direction 27. Before subjecting it to the electroplating process, the mold 18 is provided with the collar 13. Subsequently, the mold is arranged on the contact disc 11, and by means of its outer flange 15 the collar is fitted on the face 12*a* and vertex 12*b* of the turntable. As the contact disc 11 is electrically conductively connected to the contact rod 10, the mold 18 is electrically connected to the cathode 10 through the contact disc 11. The planar contact disc 11 is located in the center of the cathode and may be resiliently or rigidly constructed.

Figure 4:
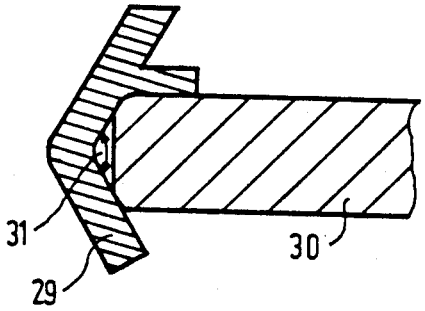
FIG. 4 is a cross-sectional view of a portion of the collar.

FIG. 4 diagrammatically shows a further embodiment, in which the outer flange 29 embraces the turntable 30 at an obtuse angle 31, and in which the turntable 30 is rounded.

I claim:

1. An arrangement for contacting a first major surface of a disc-shaped mold (18) to a first major surface of an electrically conductive contact disc (11) and holding said mold (18) to said contact disc (11) and to a first major surface of a disc-shaped table (12, 20) supporting said contact disc (11), a cathode in electrical and physical contact with a second major surface of said contact disc (11) away from said first major surface of said contact disc (11) and in physical contact with a second major surface of said table (12, 22) supporting said contact disc (11); said arrangement comprising an elastic, electrically non-conductive collar (13, 19) provided with an annular circumferential part and having a length, a first outer flange (15) contacting said second major surface (18*a*) of said table (12, 22), and together with said annular circumferential part (18*a*) collar (13, 19) surrounding said table (12, 22), a second radial annular flange (14) extending inwardly from said collar and into an annular space (28) formed between said table (12, 22) said mold (18) and said contact plate (11), said outer flange (15) being stretched around the table in such a manner so as, together with further holding members (17*a*, 19*a*) extending through the annular circumferential part of the collar (13, 19), to press mold (18) into the contact disc (11).

2. The arrangement of claim 1 wherein the collar (13,19) comprises a wall extending between the annular flange (14) and the outer flange (15) which wall has a diameter which is smaller where the annular flange (14) embraces the table (12,22) then where the outer flange (15) embraces the table (12, 22) and the further holding members (17*a*, 19*a*) extend said wall.

3. An arrangement as claimed in claim 2 wherein the outer flange (15) is constructed as a radial annular flange having an acute angle (16), and the table is a turntable (12) having a trapezoidal cross-section.

4. An arrangement as claimed in claims 3 and 1 wherein the diameter of the collar (19) is equally large at the annular flange (20) and the outer flange (21), and in that the table (22) has a rectangular cross-section and the further holding members of the collar (19) are in the form of a thickened portion (19*a*).

5. An arrangement as claimed in claim 3, wherein the outer flange (29) embraces an edge of the table (30) at an obtuse angle, said edge being rounded in cross-section, at an obtuse angle.

6. An arrangement as claimed in claim 1 wherein the surface (14*a*, 20*a*) of the annular flange (14, 20) lying opposite a outer ring surface (18*b*) of the mold (18) is located in a single plane with a surface (11*a*) of the contact disc (11).

7. An arrangement as claimed in claim 1, wherein a the bottom surface of the annular flange (14, 20), facing the table constructed as a turntable (12, 22) is provided with laminations (14*b*, 20*b*).

8. An arrangement as claimed in claim 1 wherein the collar (13, 19) is made from rubber.

9. An arrangement as claimed in claim 1, wherein the contact discs (11) are planar and may be resiliently or rigidly constructed.

10. An arrangement as claimed in of claim 1 wherein that the table is constructed as a turntable (12, 22), and in that the mold (18) is pressed onto the contact disc (11) in a torsion-resistant manner through the collar (13, 19), the contact disc being connected to the turntable (12, 22) in a torsion-resistant manner.

11. An arrangement as claimed in claim 10 or wherein the cathode is constructed as a cathode rod (10) which is rectangularly arranged with respect to the turntable (12, 22), and which forms a torsion-resistant assembly with the turntable (12, 22), the contact disc (11) when attached to the mold (18).

12. An arrangement as claimed in claim 1 wherein between the first and second major surfaces of the table (12, 20) there is a given distance and a ratio between said distance and the length of the collar (13, 19) between the annular flange (14, 20) and the outer flange (15, 21) which is selected so as to provide an initial stress of said collar (13, 19) such that the mold (18) is pressed into the contact disc (11).

13. An arrangement as claimed in claim 1 wherein the contact disc (11) has a surface area (11*a*) which exceeds the surface area of the annular flange (14, 20) to such an extent that the mold can be provided in said apparatus without being deformed.

14. An arrangement as claimed in claim 1 wherein the annular flange (14, 20) surrounds a circular inner space having a diameter which is greater than, or equal to, a diameter of the contact disc (11).

15. An arrangement for contacting a mold with, and holding it on a first major surface of a table comprising an elastic, non-conducting collar having an annular circumferential part which embraces the table on a side by means of an outer flange extending inwardly from said collar, and which comprises further members for holding the mold, and comprising an electric connection between the mold and a cathode located on said side of the arrangement, wherein the table comprises an electrically conducting contact disc which, together with the table and the mold, forms an annular space for a radial annular flange extending inwardly from said collar, and the outer flange is stretched around the table in such a manner that the mold is pressed onto the contact disc by further holding members through said annular circumferential part.

* * * * *